United States Patent [19]

Gossage

[11] 4,173,076

[45] Nov. 6, 1979

[54] SCRIBER-COMPASS WITH SPRING-LOADED CENTER PUNCH

[76] Inventor: Thomas M. Gossage, 39 Seaview, Daly City, Calif. 94015

[21] Appl. No.: 791,388

[22] Filed: Apr. 27, 1977

[51] Int. Cl.[2] ..... B43L 9/22; B25D 5/02

[52] U.S. Cl. ..... 33/27 B; 33/191

[58] Field of Search ..... 33/27 B, 189, 191

[56] References Cited

U.S. PATENT DOCUMENTS

| | | | |
|---|---|---|---|
| 772,334 | 10/1904 | Bornheimer | 33/154 G |
| 921,407 | 5/1909 | Irish | 33/154 B |
| 1,009,256 | 11/1911 | O'Leary | 33/27 B |
| 1,226,337 | 5/1917 | Lackner | 33/154 B |
| 1,303,747 | 5/1919 | Walton | 33/154 B |
| 1,572,046 | 2/1926 | Seiler | 33/191 X |
| 1,766,546 | 6/1930 | Roos | 33/149 P |
| 1,777,653 | 10/1930 | Rehm | 33/153 R |
| 2,384,707 | 9/1945 | Sweet | 33/191 X |
| 2,758,381 | 8/1956 | Benkoe | 33/149 F |

*Primary Examiner*—Harry N. Haroian
*Attorney, Agent, or Firm*—Phillips, Moore, Weissenberger, Lempio & Majestic

[57] ABSTRACT

A scriber-compass comprises a pair of first and second arms pivotally connected together at first ends thereof and a threaded rod, having a thumb nut threadably mounted thereon, adapted to selectively pivot the arms relative to each other to set the linear distance between second ends of the arms. A calibrated scale is formed on the rod to visually indicate such linear distance which coincides with the radius of a circle to be scribed on a work piece. A scibing point is formed on the second end of the first arm whereas an automatic punch is mounted on the second end of the second arm for automatically punching a centering hole upon depression of the punch against the workpiece and release of a spring-loaded impact member.

6 Claims, 6 Drawing Figures

SCRIBER-COMPASS WITH SPRING-LOADED CENTER PUNCH

BACKGROUND OF THE INVENTION

The scribing of the circle on a workpiece normally requires the utilization of four separate tools, namely, a scriber, a center punch, a ruler and a hammer. Once the scriber has been set to indicate the disposition of the center for a circle to be scribed, by use of the ruler, a workman will define such center by impacting the center punch with a hammer. One pointed arm of the scriber is then placed in the centering hole and the circle is scribed with the point formed on the other arm of the scriber. Such procedure is time-consuming and oftentimes results in an imperfect circle for the purpose intended.

SUMMARY OF THIS INVENTION

An object of this invention is to overcome the above, briefly described problems by providing a non-complex and economical scriber-compass which is adapted to automatically center and scribe a perfect circle expeditiously and efficiently.

The scriber-compass of this invention comprises a pair of first and second arms pivotally connected together at first ends thereof and adjustment means interconnected between the first and second ends of the arms for selectively pivoting the arms relative to each other to set the linear distance between the second ends of the arms. A calibrated scale is formed on the adjustment means for visually indicating such linear distance which constitutes the radius of a circle to be scribed. A scribing point is formed on the second end of the first arm whereas a punch means is mounted on the second end of the second arm for automatically punching a centering hole for the circle upon depression of the second arm against a workpiece.

BRIEF DESCRIPTION OF THE DRAWINGS

Other objects of this invention will become apparent from the following description and accompanying drawings wherein.

DETAILED DESCRIPTION

Figure 1:
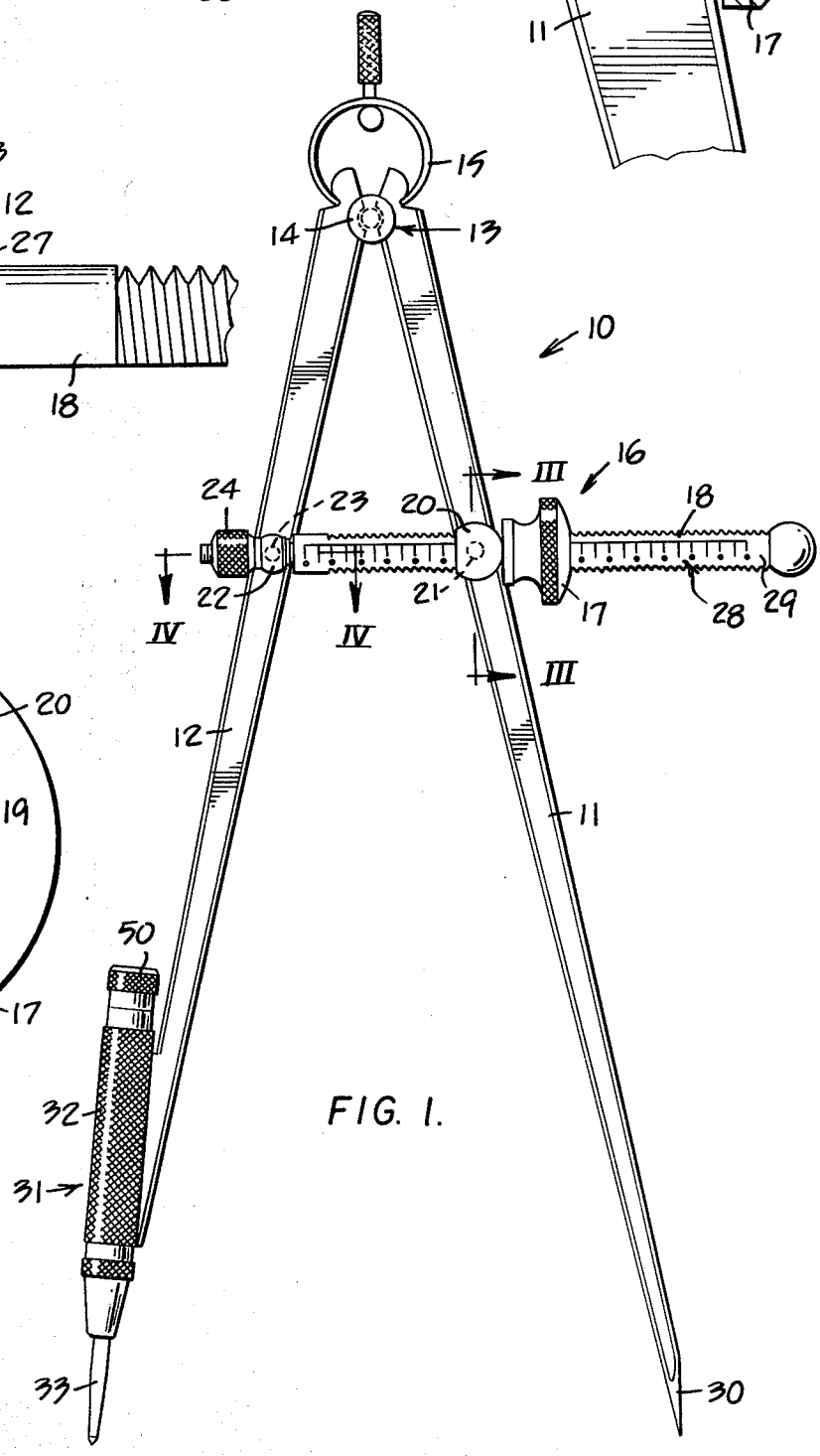
FIG. 1 is a side elevational view of a scriber-compass embodying this invention.

FIG. 1 illustrates a scriber-compass 10 comprising a pair of first and second arms 11 and 12, respectively, having first ends thereof pivotally connected together at 13. In particular, the arms are pivotally mounted on a common pin 14 and a bow spring 15 is mechanically connected between the first ends of the arms, above pivot pin 14, to bias them towards each other. Thus, the bow spring will also function to bias the lower or second ends of the arms away from each other in a conventional manner.

Figure 3:
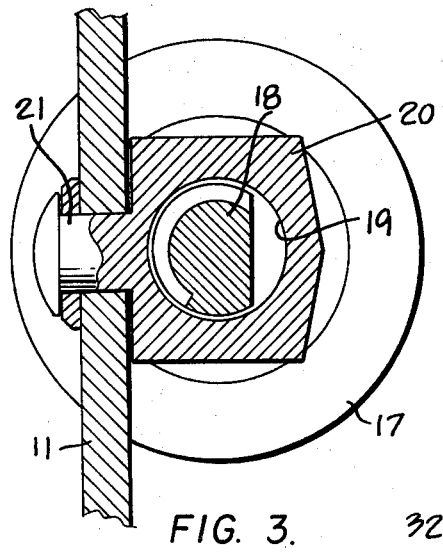

An adjustment means 16 is interconnected between the first and second ends of the arms for selectively pivoting the arms relative to each other to set the linear distance, coinciding with the radius of a circle, between the second ends of the arms. Such adjustment means comprises a thumb nut 17 threadably mounted on a threaded adjustment rod 18. As shown in FIG. 3, the rod is slidably mounted in a bore 19, formed through a supporting bracket 20 secured to first arm 11 by means of a pivot pin or rivet 21, for example.

Rod 18 is further mounted on second arm 12 by a collar 22 secured to a pivot pin or rivet 23. Rivets 21 and 23 are adapted to pivot on arms 11 and 12, respectively, upon movement of the arms relative to each other to thus compensate for the pivoting of rod 18 during selective adjustment of the scriber-compass. Such adjustment is effected by selectively rotating thumb nut 17 on rod 18 with bow spring 15 functioning to constantly maintain bracket 20 of arm 11 in bearing contact with the inboard side of the thumb nut.

Figure 2:
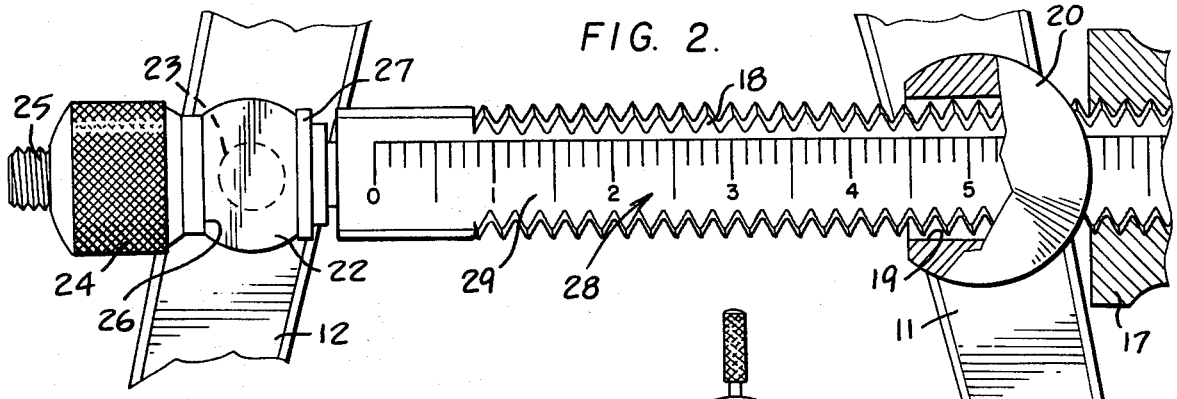
FIG. 2 is an enlarged and partially sectioned view of adjustment means for selectively pivoting arms of the scriber-compass relative to each other and further illustrates a calibrated scale formed on a threaded adjustment rod of the adjustment means.
Figure 4:
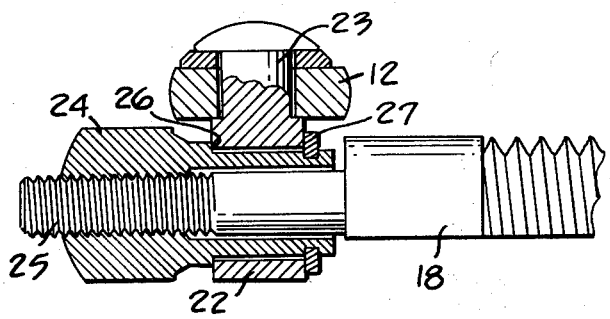
FIGS. 3 and 4 are enlarged sectional views, taken in the direction of arrows III—III and IV—IV in FIG. 1, respectively, illustrating details of a pair of mountings for the threaded adjustment rod on the arms of the scriber-compass.

Referring to FIG. 4, a second thumb nut 24 may be threadably mounted on a threaded and reduced end end extension 25 of rod 18. The latter thumb nut is held in a preset axial position relative to rod 18 by a shoulder 26 formed thereon and by a snap ring 27 mounted thereon to abut collar 22 along with the shoulder. Thumb nut 24 is thus adapted to provide an adjustment means to compensate for any inaccuracies in a calibrated scale 28, formed on a flat outer surface 29 of rod 18, due to wear or the like. If so desired, a wing nut or other suitable lock nut (not shown) could be threadably mounted on the outer end of rod extension 25 to positively assure non-rotation of thumb nut 24 during use of the scriber-compass.

Figure 5:
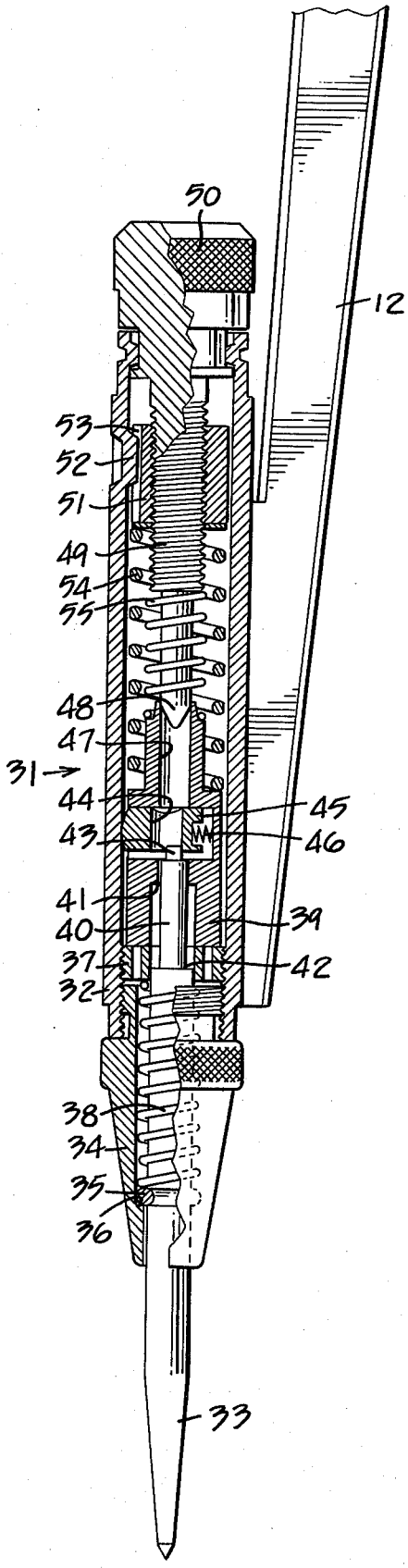
FIG. 5 is an enlarged sectional view of an automatic punch mounted on one of the arms of the scriber-compass.
Figure 6:
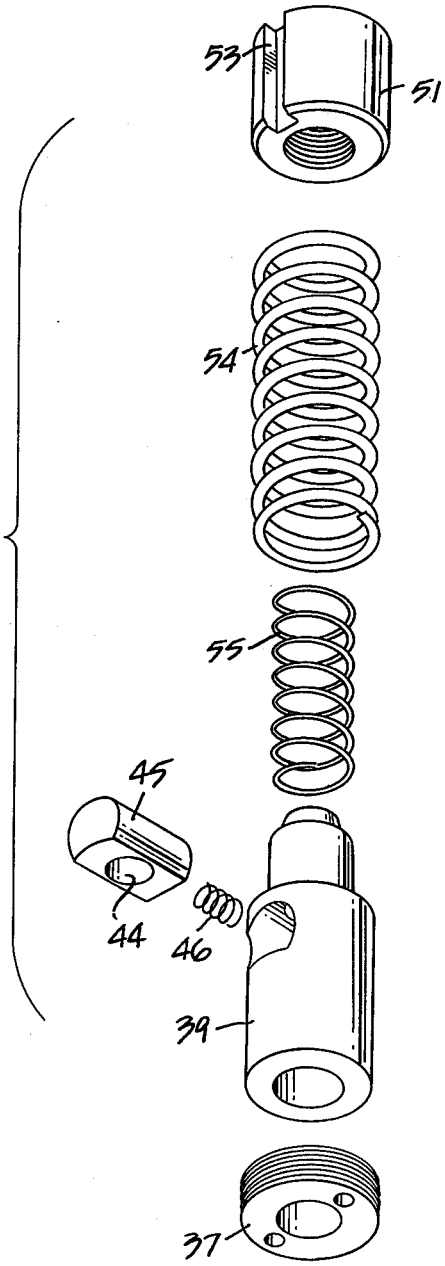
FIG. 6 is an exploded isometric view of internal mechanisms of the automatic punch.

Referring once again to FIG. 1, a scribing point 30 is formed on the second or lower end of first arm 11 whereas a punch means 31 is mounted on the second end of arm 12. Referring to FIGS. 5 and 6, the punch means comprises an automatic punch for automatically punching a centering hole in a workpiece adapted to have a circle scribed thereon upon depression of arm 12 against the workpiece. The punch comprises a tubular housing 32 having an elongated punch 33 reciprocally mounted therein.

Punch 33 is retained in the housing by means of an end cap 34, threadably mounted thereon, and a snap ring 35 mounted on the punch to engage a ledge 36 of the cap. A retaining plug 37 is threadably mounted in the housing and a first compression coil spring 38 is mounted on punch 33 and is disposed between snap ring 35 and plug 37. A tubular impact member 39 is reciprocally mounted in the housing and has an upper reduced end portion 40 of punch 33 reciprocally mounted in a bore formed therethrough which terminates at its lower end at an impact shoulder 41. The punch has an impact shoulder 42 and a further reduced end portion 43 formed thereon as an extension of portion 40 and which is normally disposed in a bore 44 formed in a detent member 45 when the punch is in its illustrated unloaded condition of operation.

Detent member 45 is biased leftwardly in FIG. 5 by a second compression coil spring 46 to place bore 44 in nonaligned relationship relative to extension portion 40 of punch 33. A bore 47 is formed in impact member 39, in axial alignment with bore punch portion 40, to receive the punch portion for purposes hereinafter described. Bore 47 is further adapted to slidably receive a tubular extension 48 secured on a threaded member 49 which is, in turn, secured to a knurled thumb nut 50.

An adjustable collar 51 is threadably mounted on member 49 and is prevented from rotating on the member by a keyway arrangement comprising a key 52 formed on housing 32 and a slot 53 formed on collar 51. It can thus be seen that knurled nut 50 is adapted to be rotated to selectively set the loading on a third compression coil spring 54, disposed between collar 51 and impact member 39. A centering or fourth compression coil spring 55 is mounted on extension 48 and is disposed between the upper end of impact member 39 and the lower end of threaded member 49, to aid in maintaining extension 48 in axial alignment with bore 47.

In operation, a workman desiring to scribe a circle on a workpiece will initially rotate thumb screw 17 on rod 18 to set the relative linear distance between scribing point 30 and punch 33 which will coincide with the radius of the scribed circle. Such radius will be reflected on calibrated scale 28 which may be graduated in inches, millimeters, centimeters, or the like. Punch 33 is then positioned at the chosen center of the circle and arm 12 is depressed by the workman to automatically punch a centering hole.

Referring to FIG. 5, depression of arm 12 will function to move punch 33 upwardly relative to housing 32 whereby the upper end of punch portion 40 will engage and move detent 45 upwardly. In turn, impact member 39 will move upwardly, along with the detent, against the biasing forces of springs 54 and 55 to place the punch in a loaded condition of operation. It should be further noted that spring 38 is likewise compressed upon upward movement of the punch relative to housing 32.

When the impact member and detent have moved upwardly a sufficient amount, the lower centering end of extension 48 will engage within bore 44 of the detent to move the detent rightwardly in FIG. 5, against the opposed biasing force of spring 46. Spring forces will then function to drive impact shoulder 41 of freed impact member 39 against impact shoulder 42 of punch 33 to drive the punch downwardly to form a centering hole in the workpiece. The working mechanisms of the punch will then automatically reposition themselves to the nonloaded condition of operation, illustrated in FIG. 5.

I claim:

1. A scriber-compass comprising a pair of first and second arms pivotally connected together at first ends thereof, said arms being at least substantially straight and disposed in the same plane, adjustment means interconnected between the first and second ends of said first and second arms for selectively pivoting said arms relative to each other to set the linear distance between the second ends of said arms comprising a threaded adjustment rod having a first thumb nut threadably mounted thereon and means for axially adjusting said rod relative to said second arm including a second thumb nut threadably mounted on an end of said rod and rotatably mounted in a collar, restraining axial movement of said second thumb nut and attached to said second arm, whereby rotation of said second thumb nut in said collar will adjust said rod axially, calibrated scale means on said adjustment means for visually indicating said linear distance, a scribing point on the second end of said first arm and lying in said plane, and punch means comprising a housing secured on the second end of said second arm to form an extension thereof and a punch, lying in said plane, reciprocally mounted in said housing for movement between an upward loaded position and a downward released position for automatically releasing said punch from its loaded position for punching a centering hole in a workpiece adapted to have a circle scribed thereon upon depression of said second arm against said workpiece.

2. The scriber-compass of claim 1 wherein the first ends of said first and second arms are pivotally connected together by a pivot pin and a bow spring mechanically interconnected between said first ends to bias them towards each other.

3. The scriber-compass of claim 1 wherein said rod is pivotally mounted on each of said first and second arms.

4. The scriber-compass of claim 1 wherein said rod has a flat surface formed thereon and wherein said calibrated scale means comprises indicia formed on said flat surface.

5. The scriber-compass of claim 1 further comprising an impact member reciprocally mounted in said housing and spring means mounted in said housing and engaged with said impact member for driving said impact member against said punch to form said centering hole.

6. The scriber-compass of claim 5 further comprising means for adjusting the preload on said spring means.

* * * * *